US007221251B2

(12) United States Patent
Menegoli et al.

(10) Patent No.: US 7,221,251 B2
(45) Date of Patent: May 22, 2007

(54) AIR CORE INDUCTIVE ELEMENT ON PRINTED CIRCUIT BOARD FOR USE IN SWITCHING POWER CONVERSION CIRCUITRIES

(75) Inventors: Paolo Menegoli, San Jose, CA (US); Carl K. Sawtell, San Jose, CA (US)

(73) Assignee: Acutechnology Semiconductor, San Jose, CA (US)

( * ) Notice: Subject to any disclaimer, the term of this patent is extended or adjusted under 35 U.S.C. 154(b) by 85 days.

(21) Appl. No.: 11/085,322

(22) Filed: Mar. 22, 2005

(65) Prior Publication Data

US 2006/0214760 A1 Sep. 28, 2006

(51) Int. Cl.
*H01F 5/00* (2006.01)
*H01F 7/06* (2006.01)

(52) U.S. Cl. ..... 336/200; 336/223; 336/232; 29/601.2

(58) Field of Classification Search ..... 336/200, 336/223, 232; 29/602.1
See application file for complete search history.

(56) References Cited

U.S. PATENT DOCUMENTS 4,873,757 A 10/1989 Williams
5,461,353 A 10/1995 Eberhardt
5,565,837 A 10/1996 Godek et al.
5,777,539 A 7/1998 Folker et al.
5,978,231 A 11/1999 Tohya et al.
6,384,706 B1 5/2002 Iwanami
6,963,034 B2 * 11/2005 Iwanami ..... 174/260
2003/0156065 A1 * 8/2003 Jo et al. ..... 343/700 MS
2005/0057335 A1 * 3/2005 Sia et al. ..... 336/223
2005/0073295 A1 * 4/2005 Hastings et al. ..... 324/117 R

OTHER PUBLICATIONS

S.C.Tang et al. "Coreless Printed Circuit Board (PCB) Transformers with Multiple Secondary Windings for . . . ", IEEE Transactions on Power Electronics, vol. 14,No. 3,May99.
G.J.Mehas"Design of Microfabricated Inductors for Microprocessor Power Delivery", IEEE Applied Power Electronics Conference Mar. 1999.

* cited by examiner

*Primary Examiner*—Anh Mai

(57) ABSTRACT

A low cost, low EMI air core inductor fabricated on printed circuit board for power conversion circuits is described. The inductive element combines the advantages of high efficiency and minimum board height requirements. It allows high frequency switching without adding undesired magnetic losses and minimizing the electro-magnetic interferences in form of radiated energy. The absence of any magnetic layer adds to the simplicity of the manufacturing process resulting in lower cost. This inductive element allows operation for the conventional and higher frequency step-up and step-down switching voltage converters minimizing the size and cost of output capacitors and reducing the output voltage ripple.

6 Claims, 5 Drawing Sheets

AIR CORE INDUCTIVE ELEMENT ON PRINTED CIRCUIT BOARD FOR USE IN SWITCHING POWER CONVERSION CIRCUITRIES

BACKGROUND OF THE INVENTION

1. Field of the Invention

The present invention relates to the manufacture of magnetic structures and electric reactive components, and more specifically to an inductor formed on a printed circuit board.

The invention also falls within the field of switching voltage regulators and electronic power supplies, which convert energy from one level to another. These devices have been common in all electronic systems. More specifically, the invention falls into the class of voltage regulators referred to as buck and boost converters, which convert a voltage to a higher or lower voltage. The present invention further relates to passive components structures embedded on a printed circuit board for use in power conversion circuits and techniques.

2. Brief Description of Related Art

Switching power converters are common systems which typically have an input terminal for receiving an input voltage, and an output terminal which supplies current to a load. The output terminal provides a substantially fixed voltage independent of the magnitude of the input voltage or the current provided to a load. These components typically use combinations of switches, inductors, transformers and capacitors to implement highly efficient transformation of DC and AC power.

The magnetic elements, inductors and transformers, are typically built as discrete components using multiple turns of wire around ferromagnetic cores. The use of ferromagnetic cores provides both higher inductance values in a given volume and suppression of stray magnetic fields.

There is continual demand for improved efficiency in the power conversion components. Many switching voltage regulators have been replacing the more common linear regulators, however in some specific consumer applications the use of switching power converters has not been possible for several reasons, the most common being the inductor's cost and in some cases the critical height requirements for the components on the circuit board.

The size of the inductive element and its cost increase with the inductance of the components and its current carrying capability. In order to minimize both the cost and the height of the inductor, it would be reasonable to use a lower value inductor. In order to use small inductance inductors, the switching frequency must increase. Increasing the switching frequency causes switching losses in the solid-state power switches and their associated drivers, but more importantly the magnetic losses in the inductor become predominant, mainly due to the magnetic hysteresis and to the Eddy currents in the ferromagnetic cores. In particular this second contribution to the magnetic losses is increasing with the square of the switching frequency. The Eddy currents are generated in any electrical conductive element that is close enough to the inductor to be crossed by the magnetic field lines. The Eddy currents reveal themselves in an equivalent way to more traditional resistive losses.

At very high frequencies, it is a common RF (Radio-Frequency) technique to utilize the inductance of a metal trace of an integrated circuit or of a printed wiring trace as a known inductive element to form filters, antennas and matching networks. Although the inductance values thus achieved are generally quite low (tens of nano Henrys), this is a practical technique for many RF applications. There are well known problems with this technique, as the resulting inductors have generally lower "Q" than can be generated otherwise, and adjacent inductors will tend to "couple" in manners that can be difficult to manage.

Based upon a long history of the use of printed wiring inductors in RF applications and a variety of attempts to integrate inductor and transformer windings onto the PCB, it is conventional wisdom that air core inductors formed by printed wiring boards are impractical for power conversion applications for several reasons:

a) Inductance values too low, b) Inductor Q is poor, c) Inductor consumes large board space, d) Inductor creates large undesired magnetic fields.

While these objections were at one time quite valid, the subject invention makes it possible to build air core magnetic structures on the printed wiring board that can provide adequate performance also for switching power conversion components. The following issues mitigate the known problems.

In recent decades, particularly following the introduction of the power MOSFET, switching frequencies for switching power supplies have migrated from 20 kHz to well over 1 MHz. Since the output power of a switching converter is proportional to the switching frequency and to the inductance value, the reduction of the time period between switching cycles has allowed the use of smaller inductance inductors. In addition a higher switching frequency is naturally producing a lower output voltage ripple, typically requiring a smaller filter output capacitor.

A limiting factor in many high frequency switching power circuits is the power dissipation in the magnetic structure due to the lossy nature of ferromagnetic material at high frequencies. The magnetic hysteresis intrinsic of any ferromagnetic material causes a dissipation that is typically increasing linearly with the switching frequency. In addition Eddy currents in the core, increase quadraticly with the frequency and they contribute to the total magnetic loss. These limitations can be overcome with an air core inductor, in fact the lower magnetic permeability of air and, more importantly, its inherent linearity eliminates totally the magnetic losses.

The speed of the electronic circuitry on integrated circuits and the switching speed of power MOSFET devices pose no present barrier to raising switching frequencies even higher. The higher the switching frequency, the lower the required inductance in any magnetic element. A lower inductance associated with air core inductors represent a high efficiency solution, provided that means for reducing the radiated energy are implemented.

The Q of printed circuit inductors is limited by the resistance of the printed circuit trace, which has much smaller cross-sectional area than the typical round copper wire used to manufacture inductors or transformers. However, at high frequencies, the effective resistance of the winding is often limited by the "skin effect", wherein most of the current flows only in the outermost region of the conductor. The large cross-sectional perimeter of printed traces can be advantageous at high frequencies. The resistive loss of the printed wiring solution may still be greater than that of a conventional magnetic component and nevertheless have lower overall loss due to the lack of a lossy ferromagnetic core.

The board space consumed by printed circuit inductors has a cost, but on multi-layer boards, a conductive winding made on an inner layer of the board uses no surface area and adds no height constraint. In many modern systems, board space may not be so critical as the height of components on the board, which often have stringent height requirements due to small mechanical packages. The decreasing inductance value of the magnetic components as switching frequencies increase also contributes to the shrinking of required board space.

The use of multiple anti-phased windings, as disclosed in the present invention, makes a considerable impact on reducing both far-field and near-field Electro Magnetic Interferences (EMI) concerns. The coupling of the magnetic field of a printed wiring inductor to nearby circuitry due to the stray magnetic fields can be minimized by the subject invention.

The conventional means of creating an inductor in an integrated circuit or in a printed wiring board is the spiral inductor, as shown in FIG. 1A. The spiral inductor can be characterized by its outer diameter, its inner diameter, the number of turns and the width (and space) of the copper traces. Because of the spiral nature of the structure, outer windings have a larger diameter than inner windings, such that the nominal inductance of each winding varies. FIG. 1B shows the inductor L1 with its associated magnetic lines, when current is flowing in the inductor.

A well-established principle in constructing practical inductors is the mutual inductance of windings which will produce a common magnetic flux. When multiple windings, which are not coupled, are placed in series, the total inductance is the sum of the individual inductances. When n windings that are well coupled are placed in series, the inductance increases by a factor of n*n, that is in a quadratic way. It is also possible, by reversing the polarity of coupled windings, to reduce the effective inductance to less than the sum of the individual windings.

In the spiral inductor, adjacent windings can be well coupled, but because each turn has progressively changing inductance, the coupling of one winding to the next cannot approach unity. If a second spiral inductor with similar diameter, etc. is stacked above or below the first in very close proximity, the coupling between the two spiral inductors can be very close to unity.

An unfortunate manner of coupling however is the coupling to any closed conductive path that surrounds the spiral. Even if coupling is significantly less than unity, the coupling makes any such path look much like a poorly coupled secondary on a transformer where the primary is the spiral inductor. In the case of modern printed wiring boards, this means that any ground plane that might encircle the inductor would be a shorted turn on such a transformer, which will reflect back to lower the inductance and to increase losses significantly as well as inducing a circulating current in the ground plane (Eddy currents) and an associated induced voltage between differing points on that ground plane.

The current flowing in a spiral inductor generates a magnetic field whose magnetic lines are perpendicular with the spiral plane. The magnetic field lines are always closed, and their path is uniformly distributed around the spiral with intensity decreasing with the square of the distance from the inductor. This stray magnetic field spreading around the inductor may cause undesired effects. A means of containing the magnetic field in order to minimize the effects from radiated energy is disclosed in this invention.

The use of printed wiring inductors in power conversion applications has been limited primarily to the use of windings on a printed circuit board being used in conjunction with a ferrite core to produce a low profile inductor or transformer. A prior art example of a low profile transformer is disclosed in Williams (U.S. Pat. No. 4,873,757).

A further prior art example of a low profile inductor using printed wiring board in conjunction with ferromagnetic cores is disclosed in Godek et al. (U.S. Pat. No. 5,565,837). Such assemblies use the inherent ease of manufacture of three-dimensional wiring within the circuit board to create extremely consistent windings eliminating the need for mechanical bobbins, windings, and the interconnection of the windings to the circuitry on the printed wiring board.

Another prior art application of printed wiring magnetic structures for power conversion has been the use of coupled windings on the printed wiring board as a pulse transformer (as disclosed in IEEE Transactions on Power Electronics, Vol. 14, NO. 3, May 1999 "Coreless Printed Circuit Board (PCB) Transformers with Multiple Secondary Windings for Complementary Gate Drive Circuits" by S. C. Tang et al.). This application used the inductive element of the transformer as a signal transmission element rather than as a means of processing power, and as mentioned, illustrated some of the potential problems with using magnetic structures composed of printed windings.

A further prior art application of printed board spiral inductor is disclosed in Iwanami (U.S. Pat. No. 6,384,706). This multi-layer printed board features plural spiral-shaped interconnected structures in conjunction with insulative magnetic layers between the structures to maximize the total inductance for use as de-coupling (filter) inductor of high frequency currents from the power supplies to the integrated circuits.

Another prior art application of multi-layered printed circuit board inductor or transformer is disclosed in Folker et al. (U.S. Pat. No. 5,777,539). This inductor or transformer uses a stack of conductive layers to form several turns with a ferrite core that passes through a hole in the printed circuit board within the conductors.

A further prior art application of printed wiring board with integrated coil inductor is disclosed in Tohya et al. (U.S. Pat. No. 5,978,231). A power conductive layer and a ground conductive layer are partially cut to form conductors that are connected through via holes in order to form a spiral inductor. An electric insulating ferromagnetic layer is also added to increase the total inductance.

A further prior art application of printed circuit board inductor is disclosed in Eberhardt (U.S. Pat. No. 5,461,353). A spiral inductor is formed connecting conductive paths on two intermediate separate layers shielding this inductor with a top layer and a lower layer to reduce the magnetic stray field.

A prior art application of air core inductor for power conversion is disclosed in IEEE Applied Power Electronics Conference March 1999 "Design of Microfabricated Inductors for Microprocessor Power Delivery" by G. J. Mehas et al. In this paper the use of an air core inductor, as a shorted coaxial line to reduce the loss and EMI in nearby conductors, was considered but not deemed practical due to the low power density of the coaxial cable.

For high performance power conversion applications multi-phase converters are very common. There are several reasons to justify the multi-phase converters approach, in particular for step-down converters, and they are:

a) simplicity of design and implementation because the load current is actually divided among the multiple phases,
b) overall space consumed by the magnetic elements,
c) reduced output voltage ripple, and
d) efficiency.

In particular, since the magnetic losses of conventional ferromagnetic core inductors are limiting the switching frequency of the converters, the use of multiple phase converters to achieve low output voltage ripple is the conventional approach. An inexpensive means of eliminating the magnetic losses is disclosed in this invention. That approach could lead to the implementation of higher frequency single-phase converters for high current and high performance applications reducing cost and complexity.

Accordingly, what is needed is a low cost, low EMI inductor for power conversion circuits that combines the advantages of high efficiency (allowing high frequency switching without adding undesired magnetic losses) and minimum board height requirements (not impacting the height of the final application circuit board). This would allow operation for the conventional and higher frequency step-up and step-down switching voltage converters minimizing the size and cost of output capacitors and reducing the output voltage ripple.

SUMMARY OF THE INVENTION

The present invention provides an inductive element with air core fabricated on a printed circuit board in a configuration that is containing the radiated energy, eliminating the magnetic losses when driven with high frequency. This technology enables high frequency switching power conversion using low cost and low space consuming inductors without negatively impacting the overall efficiency.

Every inductor, and in particular an air core inductor, generates a magnetic field that propagates in the space around the inductor itself. The magnetic field is decreasing with the square of the distance from the source of the magnetic field. Two inductors placed, on the same plane, at a significant distance from each other will inter-react among themselves such that their generated total magnetic field will be potentially reduced with respect to the single inductor case. If the two inductors are adjacent to each other on the same plane and their magnetic field is in anti-phase, a portion of the magnetic field of each inductor is coupled with the magnetic field of the other and the total resultant magnetic field around the inductors is very much reduced.

Based on this principle, an inductor can be formed as a series of two inductors on the same plane such that the current flowing within the conductors is generating two anti-phase magnetic fields. In the case of the spiral inductors that is achieved by means of having the current flowing into the spiral conductors in opposite direction and in particular clockwise in one and counter-clockwise in the other one as depicted in FIG. 2A for the inductor L2. The mutual inductance will add to the sum of the inductances of the series inductors resulting in a higher inductance inductor. Furthermore the stray magnetic field that generates undesired electromagnetic interferences in a form of radiated energy will be substantially limited and contained.

The use of spiral inductors on different layers of the printed circuit board to effectively form multi-turn inductors in conjunction to the series of anti-phase spiral inductors, as depicted in FIG. 3 for inductor L3, will further reduce the board space required for the inductor, maximizing its total inductance.

In alternative to the two inductors in series in anti-phase, four series inductors can be combined with alternate phases, as shown in FIG. 5 for inductor L5. Several combinations of different shapes of arrays of series inductors with alternate phase magnetic fields are plausible and depending on the specific power converter application one embodiment can be favored with respect to another.

Experimental results proved that, in accordance to the preferred embodiment of FIG. 4A, in a small board area of one inch square on one ounce copper two layer printed circuit board an air core inductor L4 with total inductance of more than 1 uH (micro Henry) and less than 0.5 ohms resistance can be manufactured. Inductances of several micro Henrys can also be achieved in the same board area with more turns, but the total resistance may be too high to represent a practical inductor for power conversion applications.

Power (P) is energy per unit of time. For sampled systems and in particular for switching power converter, the total power to be delivered to a load is the product of energy transferred per cycle and frequency (f). It is also known that the energy stored in an inductor is given by the product of half its inductance (L) and the square of the current (I). Therefore, we can write:

$$P=LI^2/2*f$$

This expression clearly demonstrates that, for the same level of current, in order to transfer a given power to a load, the frequency has to increase linearly with the decrease in inductance. In recent years there has been an increase of the switching frequency of the converters to reach a few MHz. The required inductance value and relative occupied board space can be reduced, but with the conventional ferromagnetic core inductors, the magnetic losses are limiting the total efficiency of the converter to the point that a higher switching frequency becomes undesirable.

The air core inductors, described in this invention, do not add any magnetic losses to the other more traditional electrical losses of the converters therefore higher frequencies are now tolerated to the extent that the switching losses in the converters and the Eddy current losses in the application are controlled and contained.

The Eddy current losses increase with the square of the frequency. That is why it is particularly important to pay attention to the conductive paths in close proximity of the inductor. Experimental results of our preferred embodiment, as of FIG. 4A, showed that any large conductive area, like a ground plane, in very close proximity of the inductor, at a frequency of a few MegaHertz, did not contribute in any appreciable way to the efficiency of the converter. Conductive elements placed in close proximity (less than half an inch) of the inductor right above or below the surface of the printed circuit board where the spiral inductor is placed may affect the overall efficiency.

A ground or supply plane can be placed in close proximity of the spiral inductor, but a metallic plane right above or below the surface of the printed circuit board where the spiral inductor is placed could negatively affect the efficiency of the power converter. If the application printed circuit board is placed in a metallic case, the case should be distanced from the board such that the Eddy currents will not become so important to affect the overall efficiency of the converter. However it is important to note that the critical distance from the conductive surface, below which the Eddy current losses become significant, is a mere geometrical and topological factor that is directly proportional to the size of the inductor itself.

Another factor to consider when designing a high frequency power converter is the "skin effect". The skin effect is the tendency for alternating current to flow mostly near the outer surface of a solid electrical conductor. The effect becomes more and more apparent as the frequency increases. The main problem with skin effect is that it increases the effective resistance of a wire for high frequencies, compared with the resistance of the same wire with dc current.

The effective resistance of a conductor due to the skin effect increases with the square root of the frequency, therefore also the skin effect losses increase with the square root of the frequency. The large cross-sectional perimeter of printed traces can be advantageous at high frequencies, because of the contained skin effect losses.

The use of the air core inductor, as disclosed in the present invention, in conjunction to the use of power conversion integrated circuit optimized for high frequency switching improves significantly upon the voltage ripple of the regulated output and upon the precision of the output in the presence of fast transients changes in the load current. In alternative the higher switching frequency could allow the use of smaller output capacitors for a given ripple.

According to the general embodiment of the present invention as shown in FIG. 2A, two conductors are printed on one layer of the multi-layer printed board and are electrically connected to each other to form one single inductive element constituted by the series of the two spiral inductors. Namely, the inductor device L2 comprises the paired two spiral formed interconnection structures La and Lb. The current is flowing in the two square spiral conductors in opposite direction. When the current is flowing clockwise in spiral inductor La and counter-clockwise into the spiral inductor Lb, the two generated magnetic fields can be coupled to each other.

The magnetic lines, representing the spatial lines that have equal magnetic field, are closed linking together the two square spiral conductors as shown in the cross section C1 of FIG. 2B. This specific topology for the inductor results in a higher overall inductance because of improved coupling between the two spiral inductors. This improved coupling also lowers the radiated magnetic energy.

According to another embodiment of the present invention, FIG. 5 shows an array of four planar spiral inductors electrically connected in series to form inductor L5 which generates alternate phase magnetic fields when current flows in it. The combination of the alternate magnetic fields emphasizes the improved confining of the undesirable stray magnetic field within the area of the inductors to eliminate electro-magnetic interference and reduce even further the losses due to the radiated power.

BRIEF DESCRIPTION OF THE DRAWINGS

Further details of the present invention are explained with the help of the attached drawings in which.

DETAILED DESCRIPTION OF SPECIFIC EMBODIMENTS

A. FIG. 2A

Figure 1A:
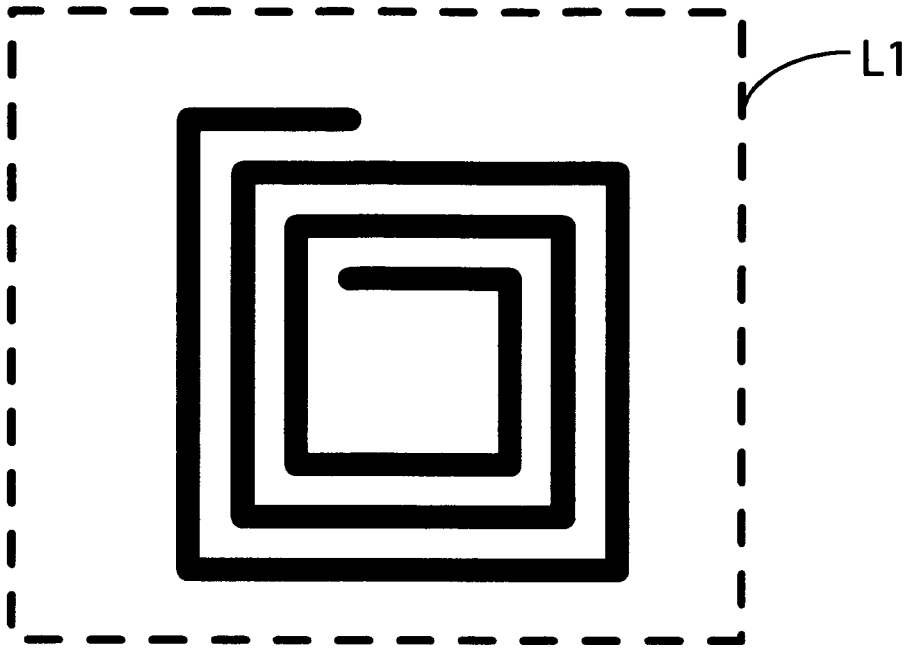
FIG. 1A is a plan view of the prior art of a conventional spiral inductor trace.
Figure 1B:
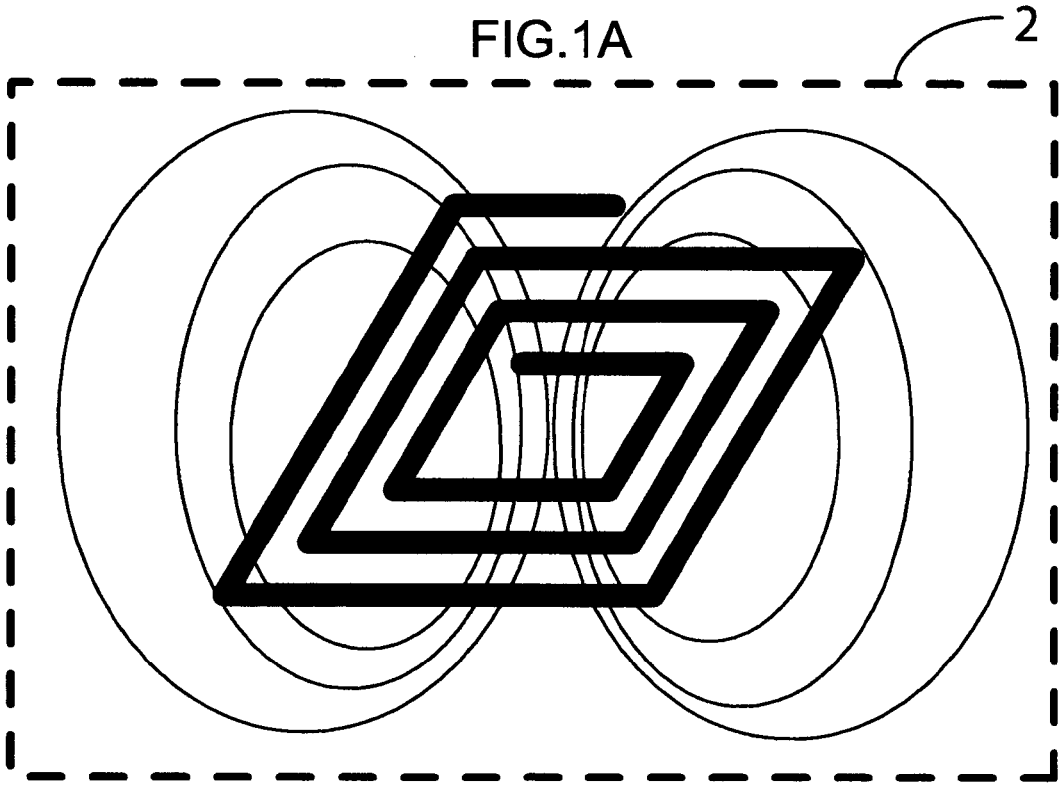
FIG.1B PRIOR ART
FIG. 1B is a prospective view of the spiral inductor of FIG. 1A with the drawing of its associated magnetic lines.
Figure 2A:
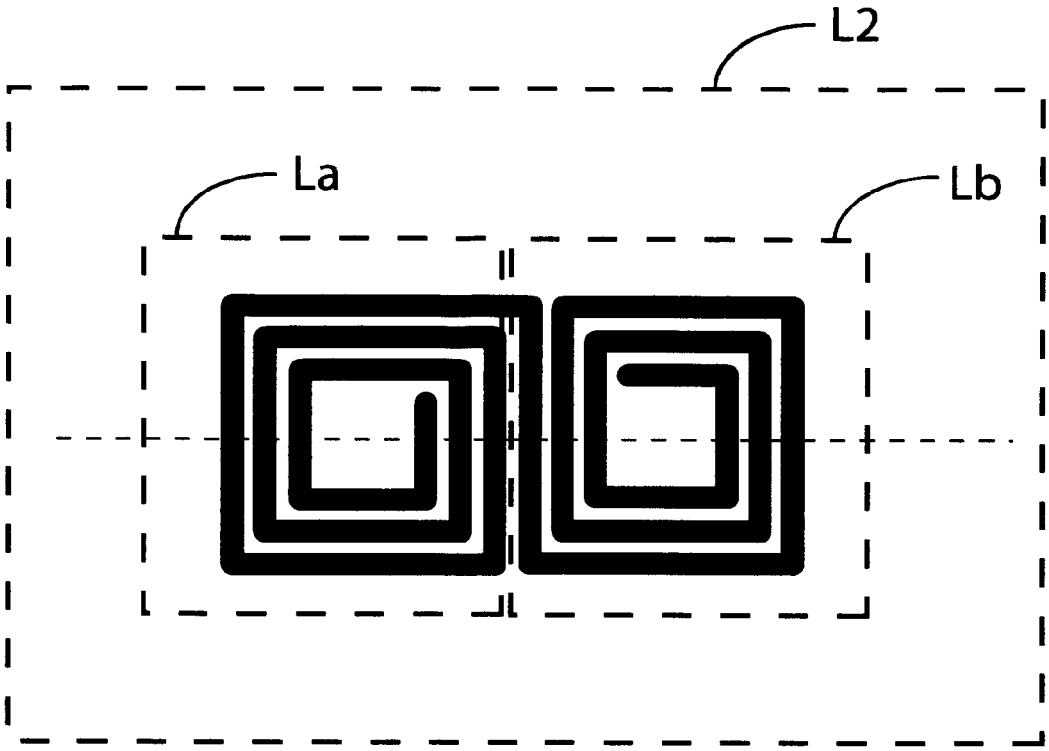
FIG. 2A is a plan view of an inductor formed by two square spiral conductors in anti-phase in a first preferred embodiment in accordance with the present invention.

FIG. 2A is a plan view of an air core inductive element made of a conductive layer on a printed circuit board to which the present invention is applied in a first preferred embodiment.

The two conductors are printed on one layer of the multi-layer printed board and are electrically connected to each other to form one single inductive element constituted by the series of the two spiral inductors. Namely, the inductor device L2 comprises the paired two spiral formed interconnection structures La and Lb The current is flowing in the two square spiral conductors in opposite direction. If the current is flowing clockwise in one spiral inductor La then it flows counter-clockwise into the spiral inductor Lb such that the two generated magnetic fields can be coupled to each other.

B. FIG. 2B

Figure 2B:
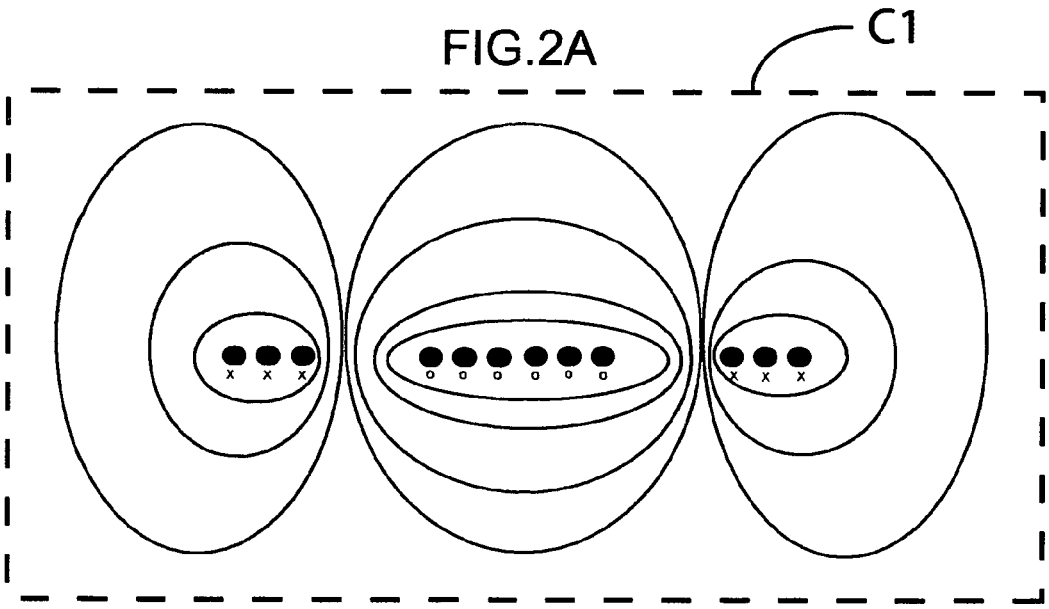
FIG. 2B is a cross section view of the spiral inductor of FIG. 2A showing the associated magnetic lines.

FIG. 2B is a cross section of the inductor device L2 of FIG. 2A with the correspondent magnetic lines, representing the spatial lines that have equal magnetic field. The magnetic lines are closed linking together the two square spiral conductors. This specific topology for the inductor is resulting in a higher overall inductance because of the mutual inductance of the two spiral inductors and in a lower radiated magnetic energy because of the reduced stray magnetic field around the inductor itself.

According to the embodiment of the present invention, the length, shape, number of plane spiral turns, conductor thickness and cross sectional perimeter may vary without substantially modifying the spirit and scope of the present invention.

C. FIG. 3

Figure 3:
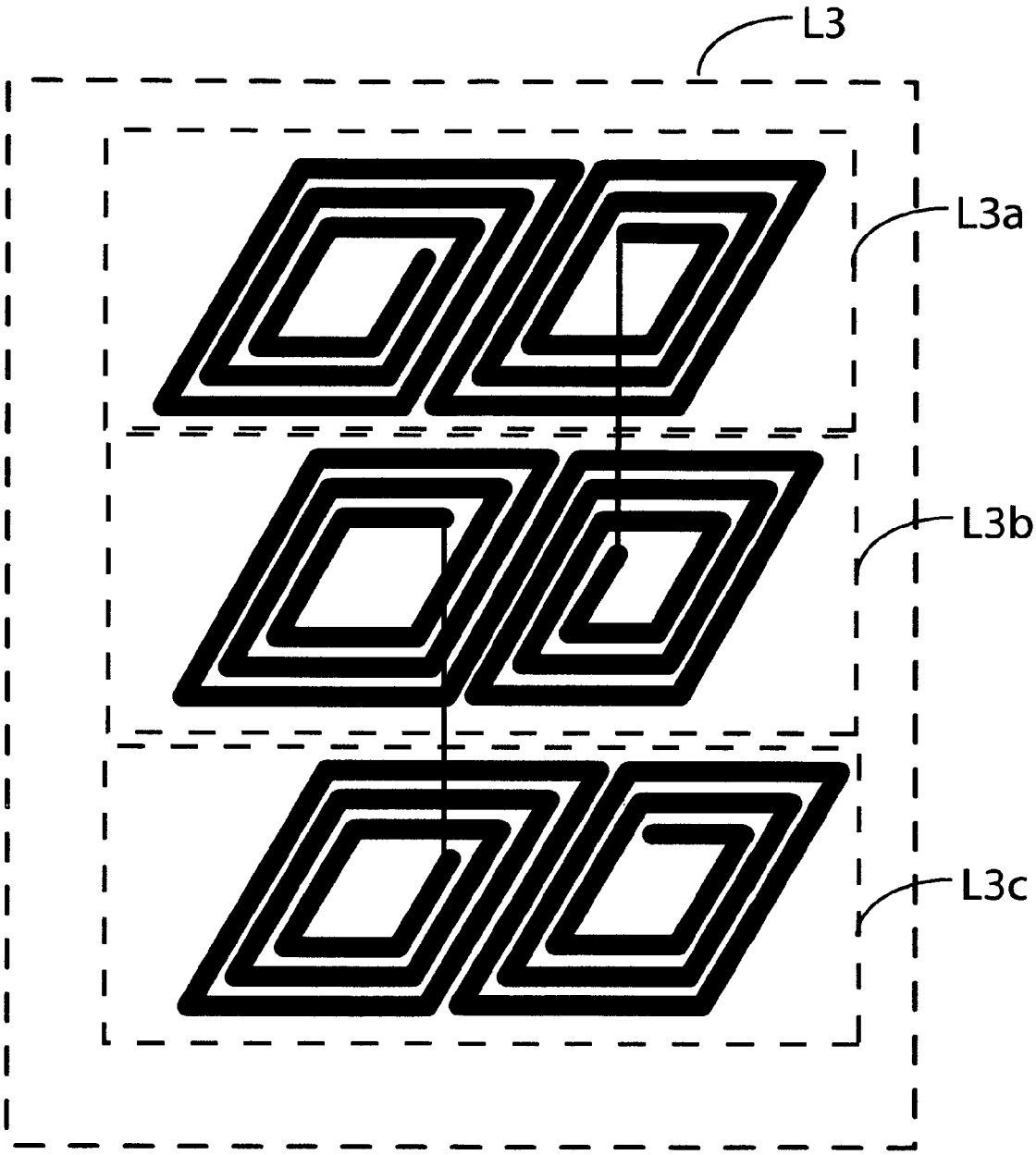
FIG. 3 is a longitudinal section of an inductor formed by two square spiral conductors in anti-phase on a multi-layer printed circuit board in accordance with the present invention.

FIG. 3 is a longitudinal section of an inductor formed by two square spiral conductors in anti-phase on a multi-layer printed circuit board in accordance with the present invention. This embodiment is an extension of the embodiment of FIG. 2 applied to multiple layers of the printed circuit board to reduce the total area and increase significantly the inductance.

A multi-layer printed board comprises alternating laminations of a plurality of dielectric layers and conductive layers. It is very common to use printed circuit boards with six, seven or even nine layers. A spiral inductor may be formed by replicating a spiral conductive path onto several stacked layers and by electrically connecting these windings together. The relative proximity of the conductive layers provides magnetic coupling between the different windings increasing the overall inductance with the square of the number of windings.

FIG. 3 shows that two stacked spiral inductors are electrically connected in series in a way to generate two anti-phase magnetic fields. That is achieved by means of having the current flowing into the two multi-layer stacks of the spiral conductors in opposite direction and in particular clockwise in one multi-winding inductor and counter-clockwise into the other multi-winding inductor.

In FIG. 3 the inductor device L3 is formed by the interconnection of the three inductors L3*a*, L3*b* and L3*c* formed by conductors on three different printed board layers. The three spiral inductors are connected together through via holes in the printed circuit board. The three individual inductors are interconnected in a way that the current is flowing in the stacked inductors in the same direction allowing the magnetic coupling.

The resulting magnetic flux of the two stacked multi-winding inductors in series is therefore contained by their mutual magnetic coupling resulting in increased inductance and lower radiated dissipated energy even if driven at higher frequency without the use of a magnetic layer with higher magnetic reluctance.

D. FIG. 4A

Figure 4A:
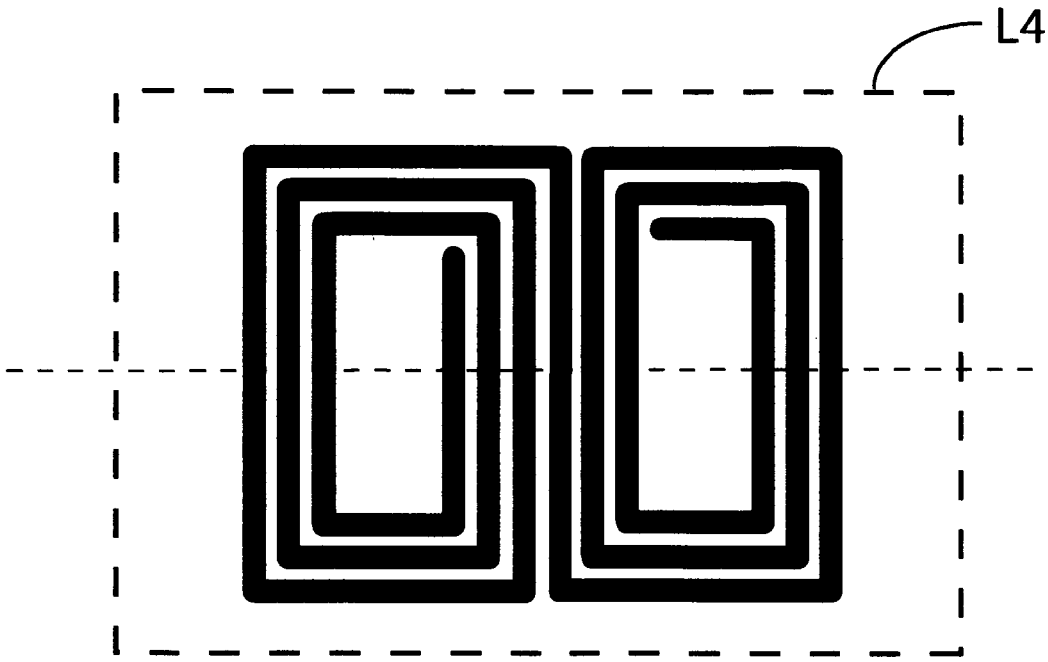
FIG. 4A is a plan view an inductor formed by two rectangular spiral conductors in anti-phase in a second preferred embodiment in accordance with the present invention.

FIG. 4A is a plan view of inductor IA formed by two rectangular spiral conductors connected in anti-phase and it represents another preferred embodiment in accordance with the present invention.

The embodiment of FIG. 4A is very similar to the embodiment of FIG. 2A with the only difference that the spiral conductors are of rectangular shape instead of square. Experimental results have proven that a rectangular shape provides a better magnetic coupling between the two plane spiral inductors reducing further the radiated energy in the proximity of the inductor itself.

An extension of this topology may also be applied to the use of multiple layer mutually coupled rectangular spiral inductors, as per the embodiment of FIG. 3, to achieve higher inductance in a smaller printed board area reducing the cost of the implementation. The geometrical reduction of the area of the inductor on the board also reduces the losses due to the Eddy currents in conductive elements in proximity of the inductor and more specifically right above or below the surface of the inductor itself.

E. FIG. 4B

Figure 4B:
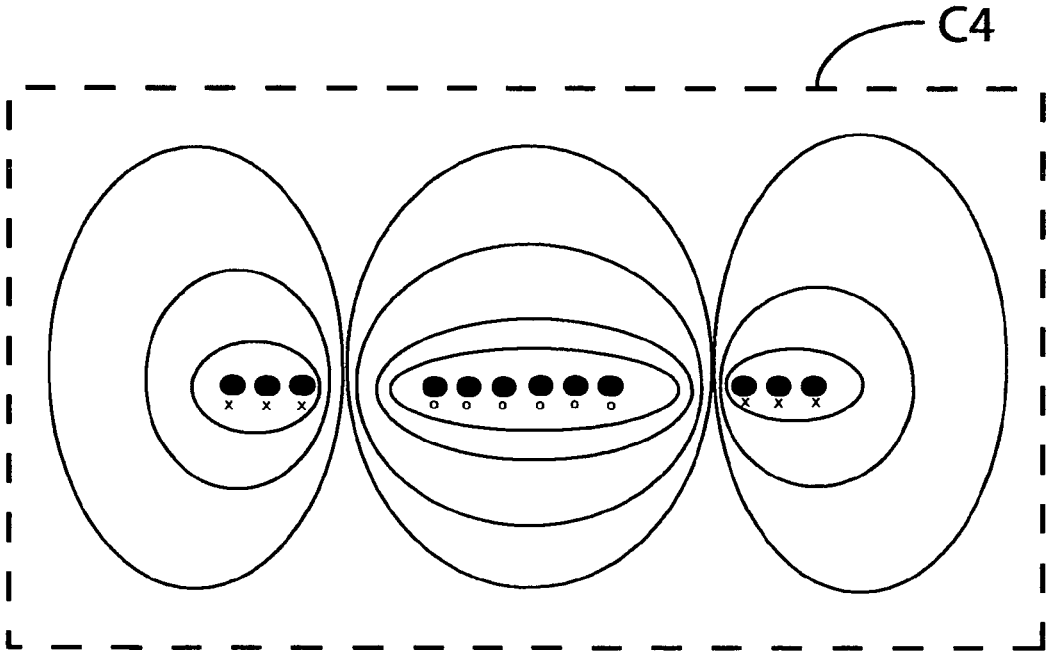
FIG. 4B is a cross section view of the spiral inductor of FIG. 4A showing the associated magnetic lines.

FIG. 4B is a cross section of the inductor device L4 of FIG. 4A with the correspondent magnetic lines, representing the spatial lines that have equal magnetic field. The magnetic lines are closed linking together the two rectangular spiral conductors. This specific topology for the inductor is resulting in a higher overall inductance because of the mutual inductance of the two spiral inductors and in a lower radiated magnetic energy because of the reduced stray magnetic field around the inductor itself.

F. FIG. 5

Figure 5:
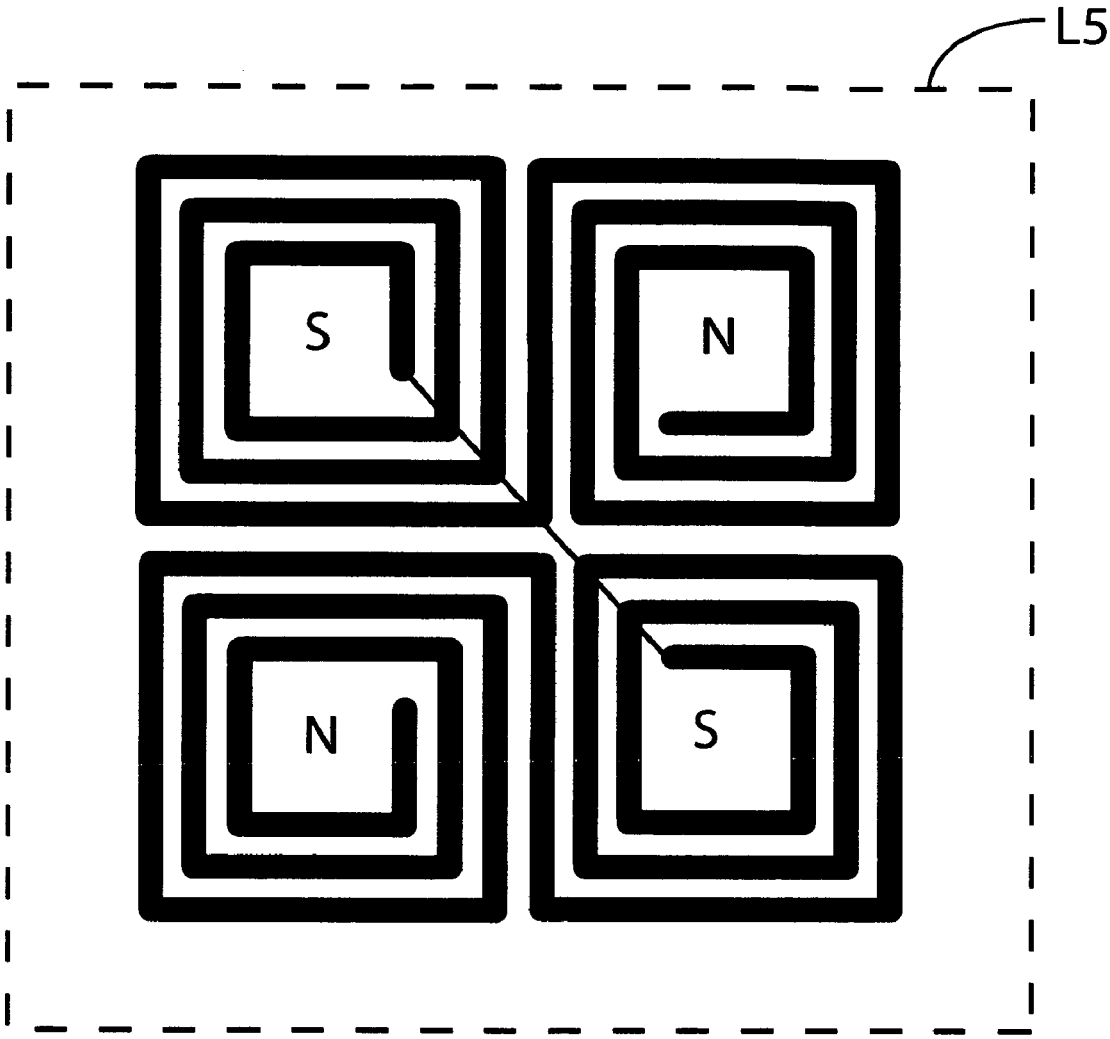
FIG. 5 is a plan view of an inductor formed by an array of four square spiral conductors in accordance with the present invention.

FIG. 5 displays another embodiment of the present invention represented by a plan view of inductor L5 formed by an array of four square spiral conductors in accordance with the present invention.

FIG. 5 shows an array of four planar spiral inductors electrically connected in series to form alternate phase magnetic fields. The combination of the alternate magnetic fields, indicated in FIG. 5 as N and S (for North and South), emphasizes the improved confining of the undesirable stray magnetic field within the area of the inductors to eliminate electromagnetic interference and reduce even further the losses due to the radiated power.

In alternative to the two inductors generating anti-phase magnetic fields, or to the four series inductors with alternate phases, several combinations of different numbers and shapes of arrays of series inductors with alternate phase magnetic fields are also plausible and depending on the specific power converter application one embodiment can be favored with respect to another.

Many other variations of the topology of the present embodiments in the number of interconnected spiral inductors and or number of used layers and or shape of the conductors manufactured on a printed circuit board are also representing valid embodiments without substantially diverging from the spirit and scope of the present invention.

Although the present invention has been described above with particularity, this was merely to teach one of ordinary skill in the art how to make and use the invention. Many additional modifications will fall within the scope of the invention. Thus, the scope of the invention is defined by the claims which immediately follow.

What is claimed is:

1. A method for storing energy in a switching power conversion system by means of a first spiral-shaped air core inductor and a second spiral-shaped air core inductor, the method comprising:

connecting said spiral-shaped air core inductors in series, such that the current flowing clockwise in said first spiral-shaped air core inductor is flowing counter-clockwise in said second spiral-shaped air core inductor, thereby generating two coupled magnetic fields orthogonal to the plane of said spiral-shaped air core inductors but of opposite polarities;

whereby said magnetic fields will tend to form a closed path through said spiral-shaped air core inductors, providing magnetic coupling between said spiral-shaped air core inductors, and whereby the magnetic radiation from said spiral-shaped air core inductors will be equal and opposite, providing a resultant minimal radiated magnetic field.

2. The method of claim 1, wherein said spiral-shaped air core inductors are fabricated on a printed circuit board.

3. The method of claim 1, wherein said spiral-shaped air core inductors further comprise windings stacked on multiple layers of a printed circuit board.

4. A method for storing energy in a switching power conversion system by means of a multiplicity of spiral-shaped air core inductors, the method comprising:

connecting said spiral-shaped air core inductors in series, such that the current flowing clockwise in a first half of said multiplicity of spiral-shaped air core inductors is flowing counter-clockwise in the second half of said multiplicity of spiral-shaped air core inductors, thereby generating a plurality of coupled magnetic fields orthogonal to the plane of said multiplicity of spiral-shaped air core inductors but of alternating polarities;

whereby said magnetic fields will tend to form a multiplicity of closed paths through said spiral-shaped air core inductors, providing magnetic coupling between said spiral-shaped air core inductors, and whereby the magnetic radiation from a first half of said multiplicity of spiral-shaped air core inductors will be equal and opposite to the magnetic radiation from the second half of said multiplicity of spiral-shaped air core inductors, providing a resultant minimal radiated magnetic field.

5. The method of claim 4, wherein said multiplicity of spiral-shaped air core inductors is fabricated on a printed circuit board.

6. The method of claim 4, wherein said multiplicity of spiral-shaped air core inductors further comprises windings stacked on multiple layers of a printed circuit board.

* * * * *